US005432308A

United States Patent [19]

Howie, Jr.

[11] Patent Number: 5,432,308

[45] Date of Patent: Jul. 11, 1995

[54] LOCKOUT STRIP FOR AN ELECTRICAL SWITCH

[76] Inventor: Robert K. Howie, Jr., 2000 N. Woodford St., Decatur, Ill. 62526

[21] Appl. No.: 288,460

[22] Filed: Aug. 10, 1994

[51] Int. Cl.[6] ..... H01H 9/28

[52] U.S. Cl. ..... 200/43.14; 200/43.16; 200/43.19; 70/202; 70/DIG. 30

[58] Field of Search ..... 200/43.14, 43.01, 43.11, 200/43.15, 43.16, 43.19; 70/DIG. 30, 192, 14, 201, 202, 203, 210, 211, 212

[56] References Cited

U.S. PATENT DOCUMENTS

| | | | |
|---|---|---|---|
| 2,560,624 | 7/1951 | Bartlett | 70/14 |
| 3,214,530 | 10/1965 | Tharp et al. | 200/43.15 |
| 3,291,924 | 12/1966 | Tharp | 200/43.15 |
| 3,327,496 | 6/1967 | De Fusco | 64/4 |
| 3,667,259 | 6/1972 | Reque et al. | 70/14 |
| 4,085,599 | 4/1978 | Fischer et al. | 70/14 |
| 5,020,342 | 6/1991 | Doan et al. | 70/14 |

*Primary Examiner*—Robert M. Fetsuga
*Assistant Examiner*—David J. Walczak
*Attorney, Agent, or Firm*—Dorn, McEachran, Jambor & Keating

[57] ABSTRACT

A lockout strip for an electrical switch of the type having a housing, an opening in the front face of the housing, an operating lever with lugs at its outer end extending out of the opening in the housing and stop surfaces at opposite ends of the opening in the housing. The stop surfaces define the "on" and "off" conditions of the switch. The lockout strip is formed of a thin, rectilinear piece of relatively stiff material, preferably plastic. An irregular shaped cutout is formed in the strip. The cutout has a central, rectangular portion of sufficient width to fit over the lever and its laterally extending lugs so as to allow the strip to be positioned against the front face of the switch housing. The cutout also has a narrow portion located longitudinally adjacent the central portion with sufficient width to receive the operating lever but not sufficiently wide to clear its lugs. This narrower cutout is inside lateral shoulders which fit under and engage the lugs of the lever. A projecting stop is formed on the bottom face of the strip so as to fit into the housing opening and engage a stop surface when the narrower cutout contacts the operating lever to thereby hold the lever in its "off" position to prevent the strip from being lifted off or slide out from beneath the lugs.

12 Claims, 2 Drawing Sheets

FIG. 7
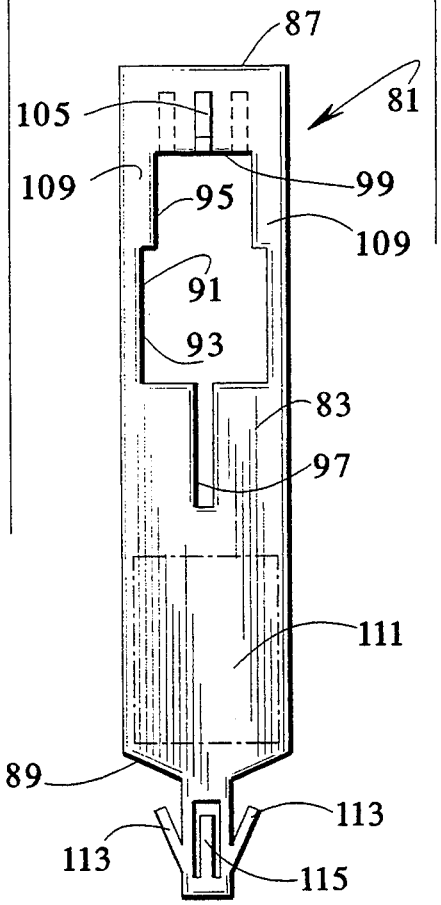
FIG. 8
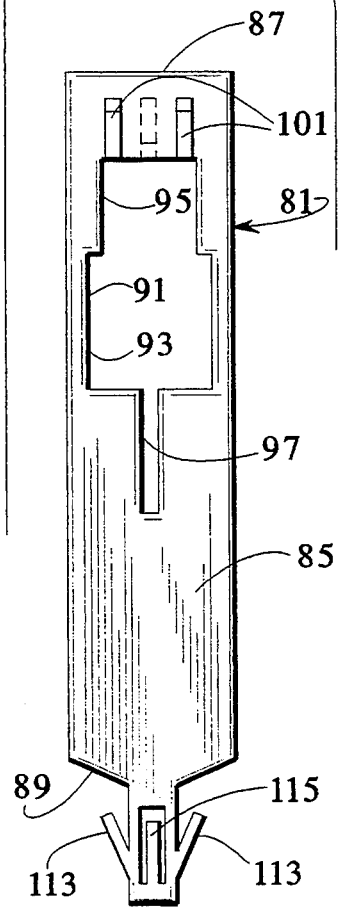
FIG. 9
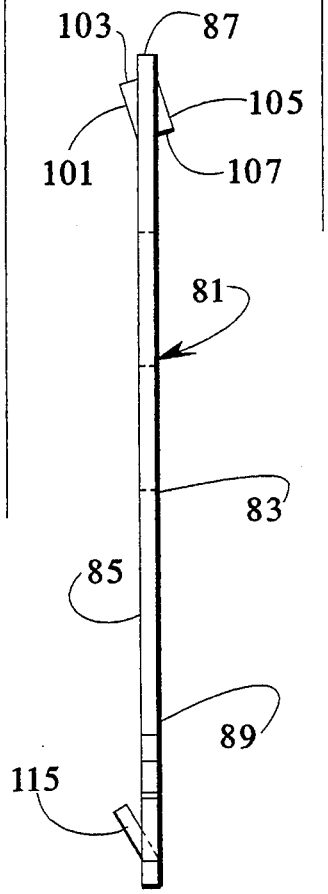
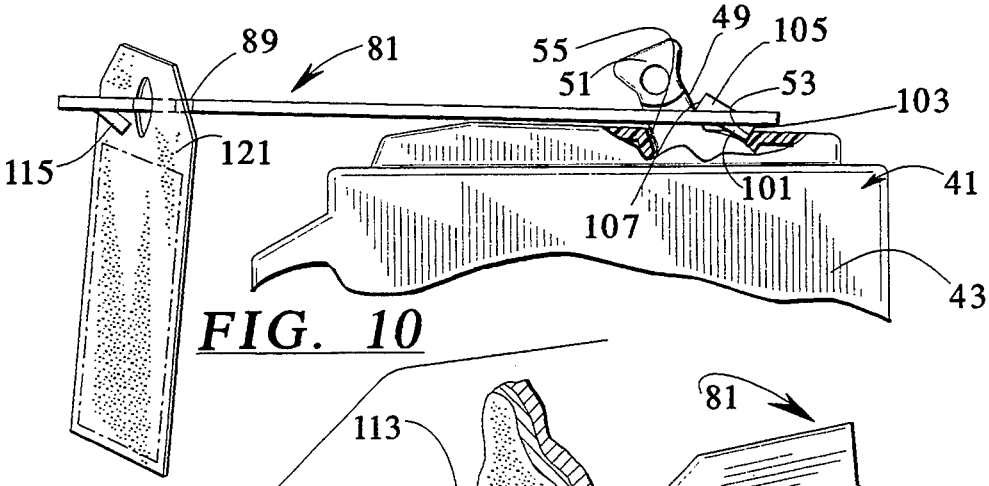
FIG. 10
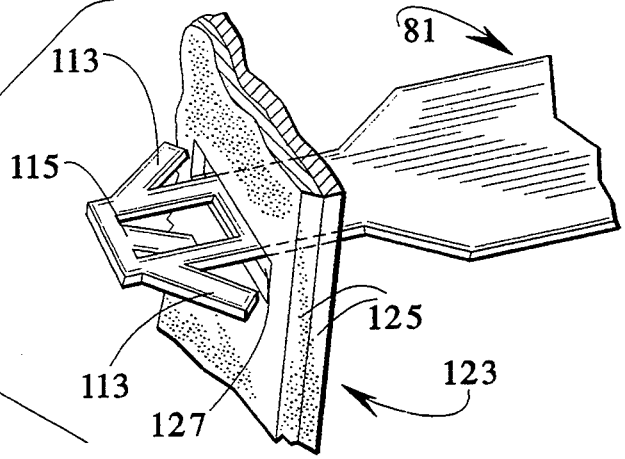
FIG. 11

LOCKOUT STRIP FOR AN ELECTRICAL SWITCH

BACKGROUND AND SUMMARY OF THE INVENTION

For years, it has been customary in industry and commerce to use lockouts to disable power sources for machinery and equipment when the machinery and equipment is being worked on either for maintenance or repair. In recent years, this standard procedure has become mandatory for businesses in the United States which are subject to the regulations of the Occupation Safety and Health Administration of the United States Department of Labor. In the past, lockout devices have customarily been locks, either keyed or combination, but their use has been by necessity limited to energy devices having handles and hasps to which the locks could be applied. In order to disable other types of power sources such as electrical switches that did not have operating handles or could not be readily adapted to receive hasps, it was necessary to install the switches in enclosures and provide mechanisms to lock out the entire enclosure even if only one switch had to be disabled. However, when an entire enclosure is locked out to protect only one switch, other workers cannot disable or actuate other switches for circuits in the same enclosure until the person who locked out the first switch unlocks the enclosure by removing his lockout device.

As part of its safety regulations, OSHA requires employers to establish safety procedures for deenergizing and reactivating equipment and machinery and to monitor and document compliance with these established regulations.

Accordingly, this invention is directed to a lockout device which may be used with individual switches of the type that do not accept locks, such as circuit breaker switches and enables an employer to completely monitor and document the deenergization and reactivation of such switches.

Another object of this invention is a lockout device which may be used with an individual switch of the circuit breaker type and when used does not affect or interfere with the operation of other switches in the same bank or enclosure.

Another object of this invention is a strip type lockout device which is adaptable to switches that do not have hasps or operating handles.

Another object of this invention is a one use, snap-in lockout device that must be cut away to be removed.

Another object of this invention is a strip type lockout device that can be removed only by rendering the device inoperative.

Another object of this invention is a strip type lockout device that can be snapped into place by the installer but must be cut apart to be removed.

Another object of this invention is a strip type lockout device that carries indicia which enables an employer to fully monitor and document the installation and removal of the lockout device in accordance with its established safety procedures and to thereby identify any employee who may violate safety procedures.

Other objects of the invention may be found in the following specification, claims and drawings.

BRIEF DESCRIPTION OF THE DRAWINGS

The invention is illustrated more or less diagrammatically in the following drawings wherein:

FIG. 7 is a top plan view of a second embodiment of locking strip of this invention;

FIG. 8 is a bottom plan view of the locking strip of FIG. 7;

FIG. 9 is a side elevational view of the locking strip of FIG. 7;

FIG. 10 is a partial side elevational view of the lockout strip of FIG. 7 installed on a switch of the circuit breaker type; and FIG. 11 is a partial view of the locking strip of FIG. 7 which is also attached at its opposite end to a lockout device for a hasp.

DESCRIPTION OF THE PREFERRED EMBODIMENTS

Figure 1:
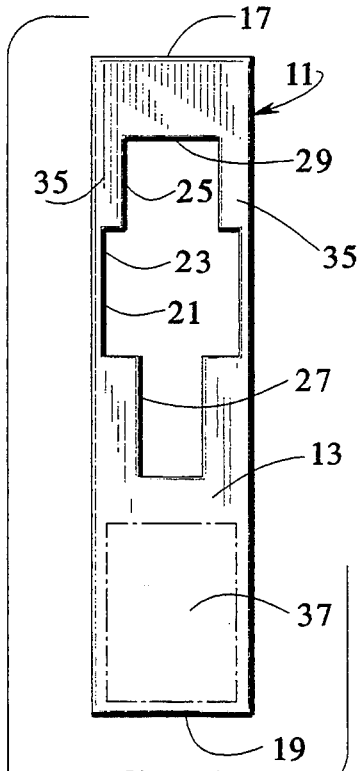
FIG. 1 is a top plan view of one embodiment of the locking strip of this invention.
Figure 2:
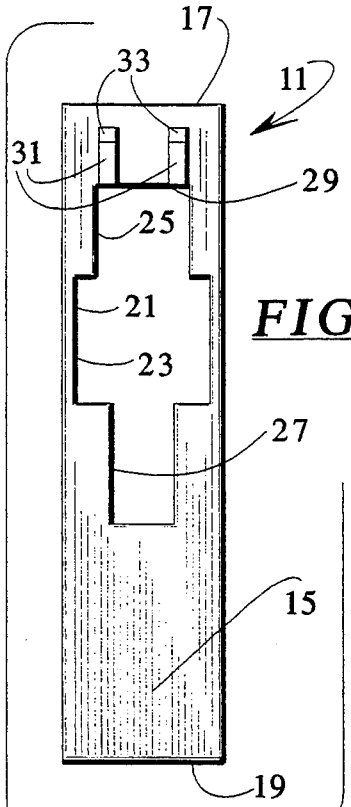
FIG. 2 is a bottom plan view of the locking strip of FIG. 1.
Figure 3:
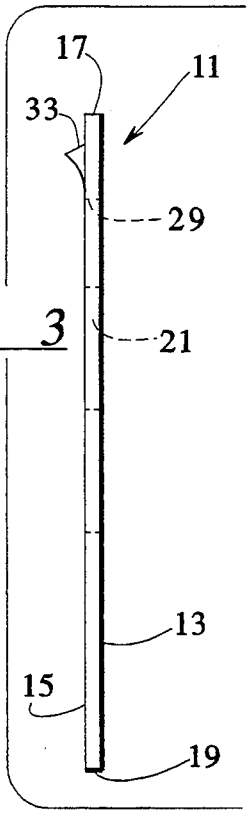
FIG. 3 is a side elevational view of the strip of FIG. 1.

A first embodiment of my invention is shown in FIGS. 1 through 5 of the drawings. It consists of a lockout strip 11 formed of an elongated, rectilinear, thin strip of relatively stiff material such as a nylon plastic. The composition of the strip may vary considerably depending upon the type of plastic used. The strip has oppositely facing flat surfaces which for purposes of explanation will be defined by their orientation shown in the drawings but it should be understood and appreciated that the orientation is for descriptive purposes only and is not a limitation on the use of the strip. Accordingly, the strip 11 has a top flat surface or face 13 shown in FIG. 1 and a bottom surface or face 15 shown in FIG. 2 of the drawings. As is inherent in such a strip, it has longitudinal ends 17 and 19. An irregular shaped cutout 21 is formed in the strip and the cutout is positioned closer to the longitudinal end 17 than to the opposite longitudinal end 19 of the strip. The cutout is somewhat key shaped having a first central rectangular portion 23. A narrow rectangular portion 25 is positioned at one end of the first portion and a third and narrower portion 27 of the cutout is formed at the other end of the first portion. The third and narrower cutout portion should be sufficiently long to extend beyond the engaging surface of the switch housing to which the lockout strip 11 is applied. Near the longitudinal end 17 of the strip, the rectangular cutout portion 25 is delineated by an edge 29.

Located between the edge 29 of the rectangular cutout portion 25 and the longitudinal end 17 of the strip are a pair of projecting stops 31 which extend outwardly from the bottom flat surface 15 of the strip. Each stop 31 has a longitudinal facing angularly inclined stop surface 33. Located laterally outwardly of the cutout portion 25 are strip shoulder portions 35.

Positioned near the longitudinal end 19 of the strip on the top flat surface 13 is a rectangular shaped indicia receiving surface 37. This surface may be pre-marked with or may have a surface treatment enabling it to receive indicia indicating a serial number identifying the particular lockout strip, an identification number of the person installing the strip and indicia indicating the particular safety procedure to be followed in applying the locking strip to and removing it from a switch.

Figure 4:
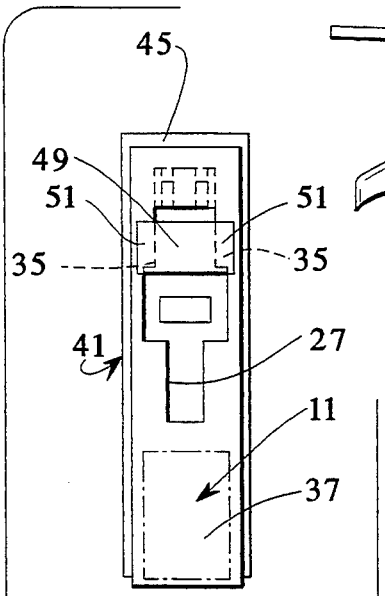
FIG. 4 is a top plan view of a locking strip of this invention installed on a switch of the circuit breaker type.

FIG. 4 of the drawings shows a lockout strip 11 applied in locking position to an electrical switch 41 of the type that is commonly referred to as a circuit breaker switch. This switch includes a housing 43 having a front face 45 formed with an opening 47 out of which an operating lever 49 extends. The operating lever 49 in this embodiment has an integrally formed pair of laterally extending lugs 51 at the outer or distal end thereof. The opening 47 into the housing is formed by converging inclined walls, namely, wall 53 which defines the "on" position of the switch and wall 55 which defines the "off" position of the switch. Engagement of the lever 49 with these walls limits the angular movement of the lever 49.

Figure 5:
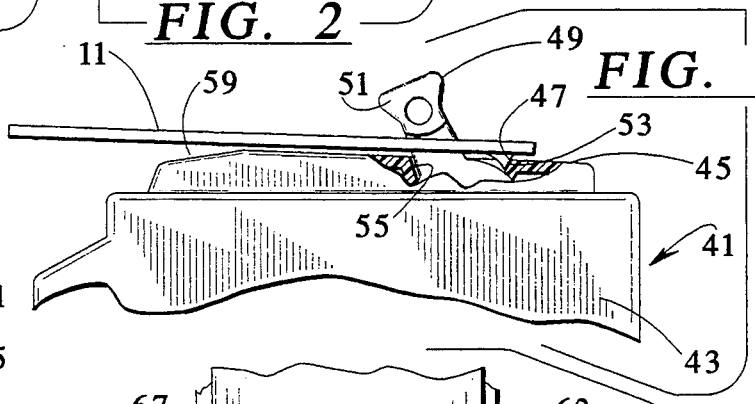
FIG. 5 is an enlarged partial side elevational view of the installation of FIG. 4.

When the lever 49 is in its "off" position shown in FIGS. 4 and 5 of the drawings, the lockout strip 13 may be applied to the electrical switch 41 by aligning the first central cutout portion 23 with the operating lever 49 and its lugs 51 and moving the lower face 15 of the strip into supporting contact with the front face 45 of the housing. The strip 11 may then be slid to the left as viewed in FIG. 5 of the drawing so that the operating lever 49 will be received in the rectangular portion 25 of the cutout with the end edge 29 of the cutout engaging the operating lever. Sliding the strip so that the operating lever fits into the cutout portion 25 will also move the lateral shoulders of the strip 11, which are located on either side of the cutout portion 25, into position beneath the lugs 51 of the operating lever.

Further, when the strip 11 is moved to the position shown in FIGS. 4 and 5 of the drawings, the projecting stops 31 will drop into the opening 47 in the switch housing 43 and engage the inclined wall 53 defining one end of the opening 47. When the stop surfaces 33 of the stops 31 engage the inclined wall 53, the lever 49 is effectively locked in its "off" position. The lockout strip 11 cannot be moved in a forward or aft direction because of the engagement of the end edge 29 of the strip with the lever 49 and the engagement of the stop surfaces 33 of the stops 31 with the inclined wall 53 of the housing. The strip 11 cannot be lifted away from the front face 43 of the housing because of the engagement of the lateral shoulder portions 35 of the strip with the laterally extending lugs 51 of the operating lever 49. Because of the stiffness of the plastic strip, it cannot be bent or lifted from this position. To remove the strip, it is necessary to cut into the narrow portion 27 of the cutout 21 which extends longitudinally beyond the portion of the front face 45 of the switch housing which is in contact with the bottom surface 15 of the strip 11. The length of the narrow portion 27 can be varied depending upon the design of the switch housing 43. If the switch housing has an inclined surface 59 on its front face to permit the blades of a cutting implement to fit under the strip, then the narrow portion does not have to extend beyond the switch housing. When the plastic strip 11 is cut in this manner, the strip 11 may be spread apart to release the shoulders 35 of the strip from locking engagement with the lugs 51 of the lever 49.

Figure 6:
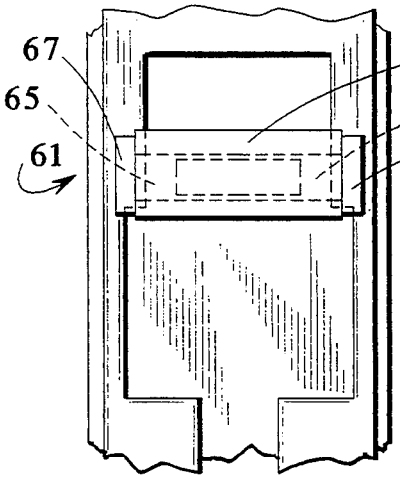
FIG. 6 is an enlarged partial top plan view of a locking strip of this invention installed on a modified form of circuit breaker switch.

FIG. 6 of the drawings shows the lockout strip 11 of this invention installed in lockout position on an electrical switch 61 of the type having an operating lever 63 which does not have integral lugs at its outer end. In order to provide lugs, a pair of headed rivets 65 are inserted into opposite sides of the operating lever. The heads of the rivets function as lugs 67 to engage the lateral shoulder portions 35 of the strip 11 to prevent the strip from being removed when the locking strip is installed in its lockout position as shown in FIG. 6 of the drawings.

A second embodiment of my invention is shown in FIGS. 7–11 of the drawings. In this embodiment, a lockout strip 81 is formed of an elongated, rectangular thin strip of relatively stiff material such as a suitable plastic of the type previously described. The strip has a top flat surface 83 and a bottom flat surface 85 with longitudinal ends 87 and 89. An irregularly shaped cutoff 91 is formed in the strip and the cutout is positioned closer to the longitudinal end 87 than to the opposite end 89 of the strip. The cutout is somewhat key shaped having a rectangular center portion 93. A narrower rectangular portion 95 is positioned at one end of the center portion 93 and an even narrower rectangular portion 97 of the cutout is formed at the other end of the first cutout portion. The outer end of the rectangular portion 95 is delineated by an edge 99.

A pair of projecting stops 101 are formed on the bottom flat surface 85 between the stop edge 99 and the longitudinal end 87 of the strip. These stops are triangular in shape and have inclined stop surfaces 103. An upper strengthening rib 105 is formed on the top flat surface 83 of the strip and is located between the lower projecting stops 101. The rib 105 has a stop surface 107 facing in the opposite direction from the stop surfaces 103. Lateral shoulder portions 109 of the strip 81 are positioned outwardly of the rectangular portion 95 of the cutout. An indicia receiving surface 111 or indicia itself may be applied to the top flat surface 83 of the strip 81. The longitudinal end 89 of the strip includes a pair of laterally extending barbs 113 and a single barb 115 projecting above the top flat surface 83 of the strip.

FIG. 10 of the drawings shows the lockout strip 81 applied in a locking position to an electric switch 41. In its lockout position, the stop edge 99 of the cutout portion 95 engages the operating lever 49 and in this embodiment, the stop surface 107 of the upper strengthening rib 105 also engages the operating lever. The stop surfaces 103 of the stops 101 engages the inclined wall 53 of the opening 47 of the housing 43 of the switch and the lateral shoulder portions 109 of the strip fit under the lugs 51 of the operating lever to prevent removal of the strip 81. An information bearing tag 121 may be slipped over the longitudinal end 89 of the strip and is held in position by the lateral barbs 113 and single barb 115.

FIG. 11 of the drawings shows the lockout strip 81 installed as a locking device for a clasp 123. This is accomplished by the locking of the strip 81 to a pivoting clasp 123 of a lockout assembly used with a switch having a hasp and a lever. The barbs 113 and 115 at the end of the strip 81 extend through aligned slits 127 in the body members 125 of a clasp. This arrangement permits a lockout strip 81 to secure not only a switch having an operating lever such as lever 49 but also a switch having an operating lever and a hasp.

I claim:

1. A lockout strip for an electrical switch of the type having a housing, an opening in said housing having end walls, an operating lever extending out of said housing through said opening, stop surfaces at opposite end walls of said opening, said lever being movable between said stop surfaces to define "on" and "off" conditions of said switch, said lever having laterally extending lugs at the outer end of said lever, said lockout strip including:

an elongated, rectilinear, thin strip of relatively stiff material having oppositely facing flat surfaces, an irregularly shaped cutout formed in said strip, said cutout having a central rectangular portion of sufficient width to be received over said lever and its laterally extending lugs so as to position one of said oppositely facing flat surfaces of said strip in contact with said switch housing, said cutout also having a narrow portion positioned longitudinally adjacent said central portion which narrow portion is sufficiently wide to receive said switch lever but not its lugs and having defining shoulders positioned laterally outwardly of said narrow portion of said cutout to fit under and engage said lugs when said lever is seated in said cutout portion, a first projection formed on the flat surface of said strip and dimensioned to be in contact with said switch housing with said first projection engaging a stop surface of an end wall of said opening when said lever is in its "off" position and said strip is positioned with its shoulders under said lugs to prevent said strip from being lifted off or slid out from beneath said lugs.

2. The lockout strip of claim 1 in which said cutout has a third cutout portion extending in the opposite longitudinal direction from said lever receiving cutout portion with said third cutout portion extending along said strip for a distance beyond the strip's contact with the face of said switch housing.

3. The lockout strip of claim 1 in which one of said oppositely facing flat surfaces has an indicia receiving surface formed thereon.

4. The lockout strip of claim 3 in which said indicia receiving surface is located longitudinally outwardly of said cutout.

5. The lockout strip of claim 1 in which at least one barb is formed on said lockout strip at one longitudinal end thereof.

6. The lockout strip of claim 1 including a second projection formed on a flat surface of said strip opposite to said flat surface on which said first projection is formed, said second projection aligned and dimensioned to engage said operating lever when said first projection engages said stop surface of said end wall.

7. A lockout strip assembly for an electrical switch of the type having a housing, an opening in said housing having end walls, an operating lever extending out of said housing through said opening, stop surfaces at opposite end walls of said opening, said lever being movable between said stop surfaces to define "on" and "off" conditions of said switch, said lever having an outer end, said lockout strip assembly including:

a pair of lugs attached to opposite lateral sides of said lever at the outer end thereof and extending laterally of said lever, an elongated, rectilinear, thin strip of relatively stiff material having oppositely facing flat surfaces, an irregularly shaped cutout formed in said strip, said cutout having a central rectangular portion of sufficient width to be received over said lever and its laterally extending lugs so as to position one of said oppositely facing flat surfaces of said strip in contact with said switch housing, said cutout also having a narrow portion positioned longitudinally adjacent said central portion which narrow portion is sufficiently wide to receive said switch lever but not its lugs and having defining shoulders positioned laterally outwardly of said narrow portion of said cutout to fit under and engage said lugs when said lever is seated in said cutout portion, a first projection formed on the flat surface of said strip and dimensioned to be in contact with said switch housing with said first projection engaging a stop surface of an end wall of said opening when said lever is in its "off" position and said strip is positioned with its shoulders under said lugs to prevent said strip from being lifted off or slid out from beneath said lugs.

8. The lockout strip of claim 7 in which said cutout has a third cutout portion extending in the opposite longitudinal direction from said lever receiving cutout portion with said third cutout portion extending along said strip for a distance beyond the strip's contact with the face of said switch housing.

9. The lockout strip of claim 7 in which one of said oppositely facing flat surfaces has an indicia receiving surface formed thereon.

10. The lockout strip of claim 9 in which said indicia receiving surface is located longitudinally outwardly of said cutout.

11. The lockout strip of claim 7 in which at least one barb is formed on said lockout strip at one longitudinal end thereof.

12. The lockout strip of claim 7 including a second projection formed on a flat surface of said strip opposite to said flat surface on which said first projection is formed, said second projection aligned and dimensioned to engage said operating lever when said first projection engages said stop surface of said end wall.

* * * * *